US010935013B2

(12) United States Patent
Venturi

(10) Patent No.: US 10,935,013 B2
(45) Date of Patent: Mar. 2, 2021

(54) AIR COMPRESSOR UNIT

(71) Applicant: FIAC S.P.A., Sasso Marconi (IT)

(72) Inventor: Adriano Venturi, Sasso Marconi (IT)

(73) Assignee: FIAC.S.R.L., Sasso Marconi (IT)

( * ) Notice: Subject to any disclaimer, the term of this patent is extended or adjusted under 35 U.S.C. 154(b) by 26 days.

(21) Appl. No.: 16/202,728

(22) Filed: Nov. 28, 2018

(65) Prior Publication Data

US 2019/0226468 A1 Jul. 25, 2019

(30) Foreign Application Priority Data

Jan. 25, 2018 (IT) ..... 102018000001825

(51) Int. Cl.

| | |
|---|---|
| ***F04B 35/06*** | (2006.01) |
| ***B65H 75/42*** | (2006.01) |
| ***F04B 35/04*** | (2006.01) |
| ***F04D 25/08*** | (2006.01) |
| ***F04D 25/06*** | (2006.01) |
| ***F04D 29/60*** | (2006.01) |
| ***F04B 39/12*** | (2006.01) |
| ***F04B 1/00*** | (2020.01) |

(52) U.S. Cl.

CPC ..... *F04B 35/06* (2013.01); *B65H 75/42* (2013.01); *F04B 1/00* (2013.01); *F04B 35/04* (2013.01); *F04B 39/121* (2013.01); *F04D 25/06* (2013.01); *F04D 25/08* (2013.01); *F04D 29/601* (2013.01)

(58) Field of Classification Search

CPC ..... F04D 29/601; F04D 25/08; F04B 1/00; F04B 35/06; F04B 39/121; F04B 35/04; B65H 75/42

USPC ..... 137/355.2, 0.23, 0.26

See application file for complete search history.

(56) References Cited

U.S. PATENT DOCUMENTS

| | | | | |
|---|---|---|---|---|
| 3,895,764 | A | 7/1975 | Roland | |
| 6,027,320 | A | 2/2000 | Hendrix et al. | |
| 7,976,290 | B2 | 7/2011 | Wang | |
| 8,757,574 | B2 * | 6/2014 | Bauck | B65H 75/4431 248/330.1 |
| 9,670,034 | B2 | 6/2017 | Skotty | |
| 2006/0196548 | A1 * | 9/2006 | Trettin | B62B 1/264 137/355.16 |

(Continued)

FOREIGN PATENT DOCUMENTS

| | | |
|---|---|---|
| CN | 101761467 A | 6/2010 |
| CN | 102052286 A | 5/2011 |

(Continued)

OTHER PUBLICATIONS

Italian Search Report dated Sep. 14, 2018 from counterpart Italian App No. IT201800001825.

(Continued)

*Primary Examiner* — Angelisa L. Hicks

(74) *Attorney, Agent, or Firm* — Shuttleworth & Ingersoll, PLC; Timothy J. Klima

(57) ABSTRACT

Described is an air compressor which can be fixed to the wall, comprising a plate which can be fixed to a wall, a supporting and containing body hinged on the plate so as to oscillate about a respective predetermined axis of oscillation, an electrically powered air compression unit housed in the supporting and containing body, a reel for winding a flexible hose for passage of the compressed air from the compression unit.

20 Claims, 3 Drawing Sheets

(56) References Cited

U.S. PATENT DOCUMENTS

| | | | | |
|---|---|---|---|---|
| 2008/0181794 | A1* | 7/2008 | Steinfels | F04B 35/04 417/234 |
| 2014/0352807 | A1* | 12/2014 | Liu | B08B 3/026 137/355.27 |
| 2015/0059861 | A1 | 3/2015 | Moore et al. | |
| 2015/0308425 | A1* | 10/2015 | Skotty | F04B 35/06 137/565.18 |
| 2018/0222715 | A1 | 8/2018 | Hall et al. | |

FOREIGN PATENT DOCUMENTS

| | | | |
|---|---|---|---|
| CN | 102596774 | A | 7/2012 |
| CN | 205842154 | U | 12/2016 |

OTHER PUBLICATIONS

International Search Report and Written Opnion dated Nov. 19, 2019 for counterpart International Patent Application No. PCT/IB2019/056246.

Chinese Office Action dated Aug. 5, 2020 from counterpart Chinese Patent Application No. 201811451067.1.

* cited by examiner

AIR COMPRESSOR UNIT

This application claims priority to Italian Patent Application 102018000001825 filed Jan. 25, 2018, the entirety of which is incorporated by reference herein.

BACKGROUND OF THE INVENTION

This invention relates to an air compressor unit.

More specifically, the invention relates to an air compressor unit which can be fixed to the wall.

Still more specifically, the invention relates to a compressor which can be fixed to the wall with an integrated reel winder.

Air compressors are used both in work and domestic environments for a wide range of purposes.

In particular, in the latter context, the use of air compressors is becoming ever greater, for example in the DIY sector or even for hobby or sporting activities, such as, for example, model-making or cycling.

The air compressor units available on the market have multiple shapes and sizes but are usually quite bulky.

In the garage where the activities listed above are generally performed the air compressors often form obstructions both to the passage of persons and to the movement of vehicles and equipment.

An electrical cable to be connected to the main power supply also necessarily lead from them, as well as a hose for distributing the compressed air, at the end of which a suitable pneumatic tool is normally connected, which can also be a simple gun.

Moreover, the unwinding and the rewinding of the hose for distributing air is not always easy and immediate.

Wall-mounted reels have been made for this purpose which allow an easy winding/unwinding of the compressed air hose.

However, these reels have not overcome the drawback of the overall size of the compressor which must still be positioned on the ground close to the reel itself and connected to it by means of a relative hose.

All this often results in unsafe conditions for people working in the vicinity of the compressor on account of its overall size and the presence of the relative electrical cable and compressed air distribution hose.

U.S. Pat. No. 6,027,320 discloses a compressor including a movable hose reel assembly.

Document US 2015/0059861 discloses a compressor system including an integrated reel.

SUMMARY OF THE INVENTION

The aim of this invention is to overcome the drawbacks of the prior art by means of an air compressor which is compact and practical to use.

A further aim of this invention is to provide an air compressor which is at the same time simple and inexpensive to make.

The technical features according to the above-mentioned objects may be easily inferred from the present disclosure.

BRIEF DESCRIPTION OF THE DRAWINGS

The advantages of the present invention are more apparent from the detailed description which follows, with reference to the accompanying drawings which illustrate a preferred embodiment of the invention provided merely by way of example without restricting the scope of the inventive concept, and in which.

With reference to the accompanying drawings, the numeral 1 denotes in its entirety an air compressor made in accordance with the invention.

DESCRIPTION OF THE PREFERRED EMBODIMENTS

Figure 1:
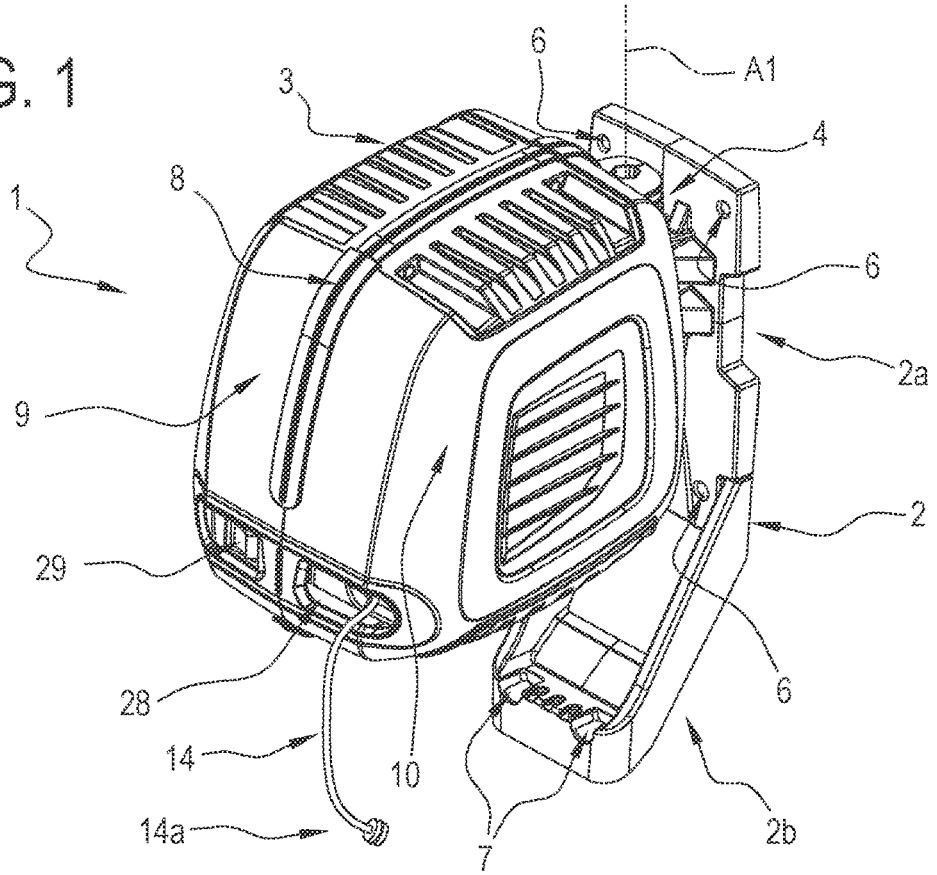
FIG. 1 is a schematic perspective view from above of an air compressor made according to the invention.

As illustrated in FIG. 1, the air compressor 1 comprises a plate 2 which can be fixed to the wall and a supporting and containing body 3 hinged on the plate 2.

The plate 2 is illustrated by way of example fixed to a wall P.

The supporting and containing body 3 is hinged on the plate 2 by means of a respective hinge 4, so as to oscillate about a respective pivot axis A1.

The hinge 4 is defined by a first hinge element 4*a* formed on the plate 2 and by a second hinge element 4*b* formed on the supporting and containing body 3.

Figure 3:
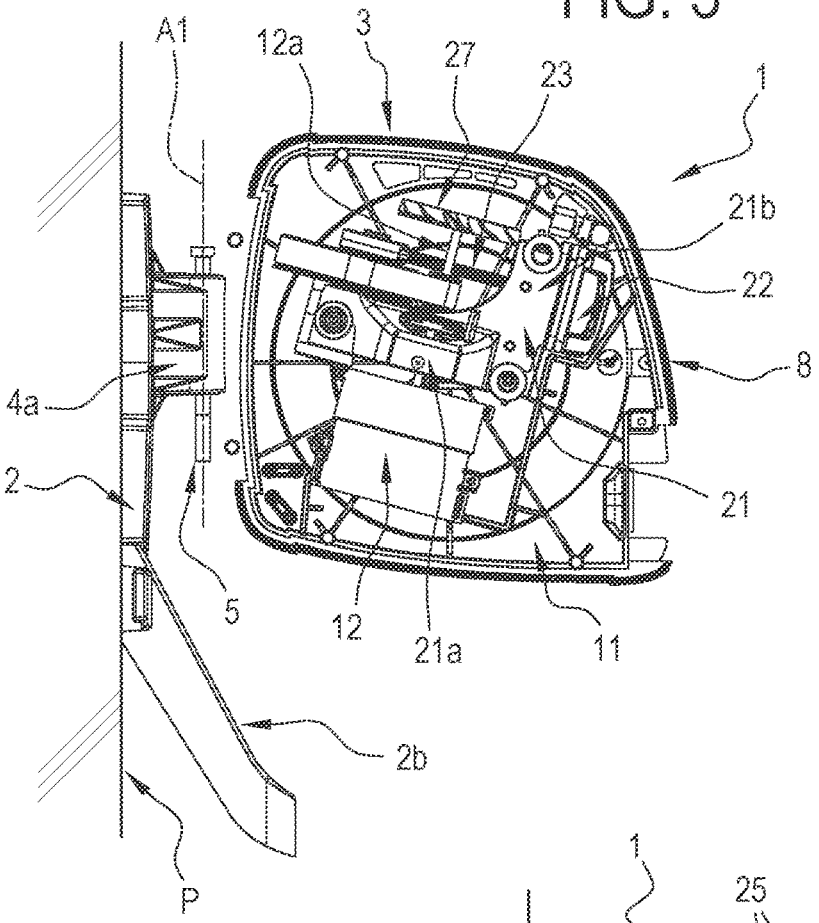
FIG. 3 is a schematic side elevation view, with some parts cut away to better illustrate others, of the air compressor according to the invention.

Both the above-mentioned first and second hinge elements 4*a*, 4*b* comprise portions with a cylindrical cavity inside of which is inserted stably a pin 5, shown in FIG. 3.

The plate 2 which can be fixed to the wall has an upper portion 2*a* and a lower portion 2*b*.

The above-mentioned hinge element 4*a* is formed projecting in the above-mentioned upper portion 2*a* of the plate 2.

On the upper portion 2*a* there are also formed a plurality of holes 6 designed for housing respective screws, not illustrated, for fixing the plate 2 to the wall.

As clearly shown in FIGS. 1 to 4, housings 7 for pneumatic tools, not illustrated, are made on the lower portion 2*b* of the plate 2.

In other words, the above-mentioned and not illustrated pneumatic tools are advantageously placed, when not used, at the housings 7, shaped for this purpose.

Again with reference FIGS. 1 to 4, the lower portion 2*b* of the plate 2 is advantageously shaped in a cantilever fashion in such a way as to allow the above-mentioned housings 7 for pneumatic tools to be suitably spaced mounted on a wall P on which the plate 2 is fixed.

Thanks to this distance of the housings 7 from the wall P, the pneumatic tools, not illustrated, can be easily placed on the respective housings 7 as they can protrude forwards from them, towards the above-mentioned fixing wall P, and away from them, in order to achieve the best equilibrium position and not to strike against the surface of the wall P.

Figure 2:
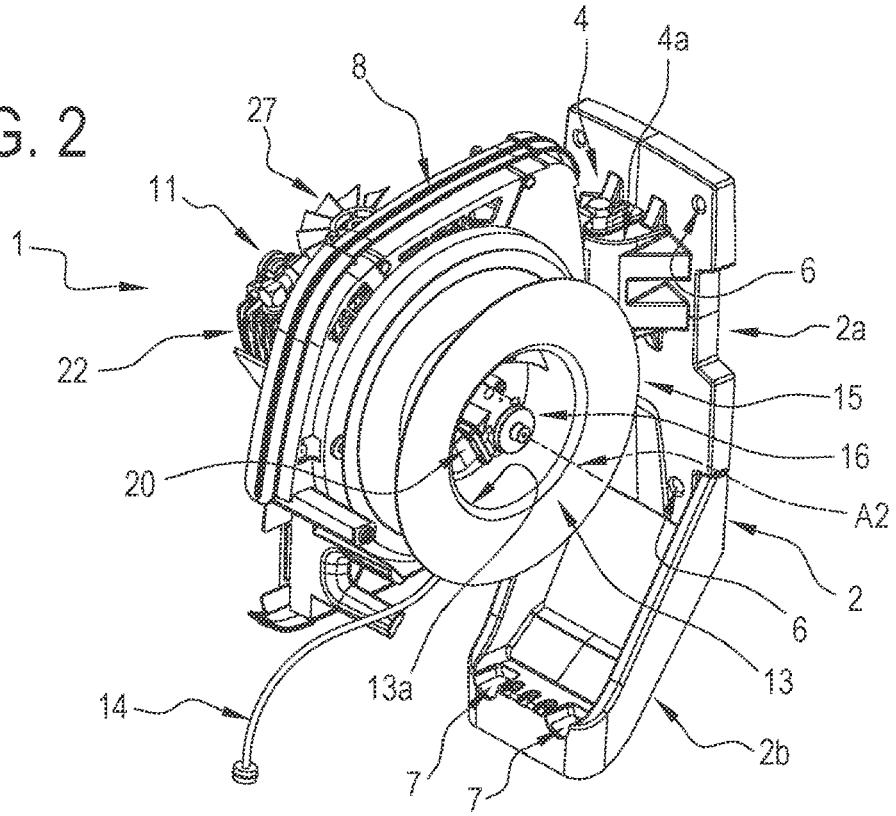
FIG. 2 is a schematic perspective view from above of the air compressor of FIG. 1 without some covering elements.

With reference to FIG. 2, the supporting and containing body 3 comprises a central wall 8 and, as illustrated in FIG. 1, two side guards 9, 10 located on opposite sides of the central wall 8.

As illustrated in FIG. 3, the compressor 1 comprises an air compression unit 11, supported by the above-mentioned supporting and containing body 3.

The air compression unit 11 is electrically powered and comprises an electric motor 12 and a pumping unit 22 which are operatively connected to each other.

As illustrated in FIG. 2, the air compressor 1 comprises a reel 13 for winding a flexible hose 14 for the passage of the compressed air generated by the compression unit 11.

The above-mentioned reel 13 is supported rotatably by the central wall 8 to rotate about a respective central axis A2.

The rotation of the reel 13 about the axis A2 determines, as a function of the direction of rotation, the winding or unwinding of the flexible hose 14 wound on it.

Advantageously, the air compressor 1 comprises an elastic mechanism for automatically winding the reel 13, of substantially known type and not illustrated, nor described further.

The above-mentioned reel 13 and automatic elastic winding mechanism form, in their entirety for the air compressor 1, respective means 15 for winding the flexible hose 14.

As illustrated in FIG. 2, the above-mentioned compression unit 11 and winding means 15 are positioned on opposite sides of the central wall 8.

The above-mentioned guard 9, 10 of the supporting and containing body 3 are also positioned on opposite sides of the central wall and designed to cover, respectively, the compression unit 11 and the winding means 15.

Figure 5:
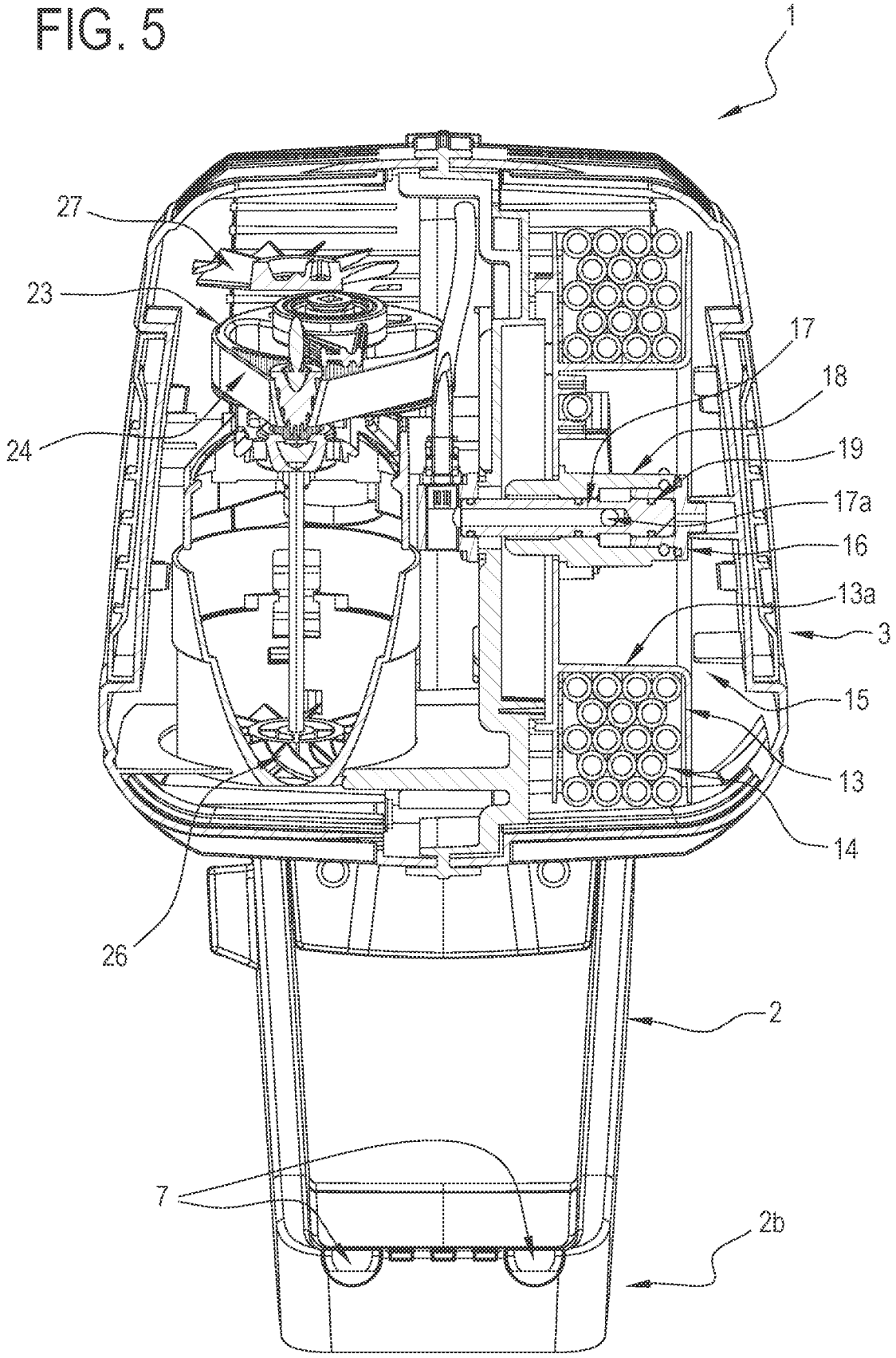
FIG. 5 is a cross section view through the line V-V of FIG. 4.

With reference to what is illustrated in detail in FIG. 5, at the central axis A2 there is a rotary element 16 for distributing the compressed air.

The rotary distributor element 16 is designed to transfer to the flexible hose 14 wound around the reel 13 the compressed air generated by the compression unit 11.

More in detail, again with reference to FIG. 5, the rotating distributor element 16 comprises a hollow cylindrical element 17 integral with the central wall 8 and an external manifold 18.

Openings 17*a* designed to place the cylindrical element 17 in fluid communication with the external manifold 18 are made on the hollow cylindrical element 17.

The external manifold 18 is supported rotatably by the hollow cylindrical element 17 and between them are interposed sealing rings 19 designed to prevent undesired escape of the air.

On the external manifold 18 is positioned a block 20, which is partly visible in FIG. 2, for connecting one end, not illustrated, of the flexible hose 14 for distributing air.

The flexible hose 14, connected to the block 20, passes inside the reel 13 through an opening made on a cylindrical wall 13*a* of the reel 13, the opening being shaped inclined so as to follow the curvature of the hose 14 which is wound.

With reference to FIG. 1, on the side guard 10 for covering the winding means 15 there is an opening 28 from which emerges an end 14*a* of the flexible hose 14 designed to be connected to a relative pneumatic tool.

As illustrated in FIG. 3, the supporting and containing body 3 comprises a supporting structure 21, fixed to the wall 8 and emerging from it, the supporting structure 21 having a first portion 21*a* designed to rotatably support the shaft 12*a* of the electric motor 12, by interposing rolling means of known type and not illustrated.

The supporting structure 21 also comprises a second portion 21*b* designed to support the above-mentioned pumping unit 22.

The pumping unit 22 is advantageously of alternating type and has a piston which is movable inside a respective cylinder, both of known type and not shown in detail in the accompanying drawings.

The movement of the pumping unit 22 occurs by means of a connecting rod-crank mechanism 23 and the motion is transmitted to the latter by the motion from the electric motor 12 by means of a transmission belt wherein a belt 24 engages between respective pulleys visible only partly in the accompanying drawings and therefore not labelled with respective reference numerals.

Figure 4:
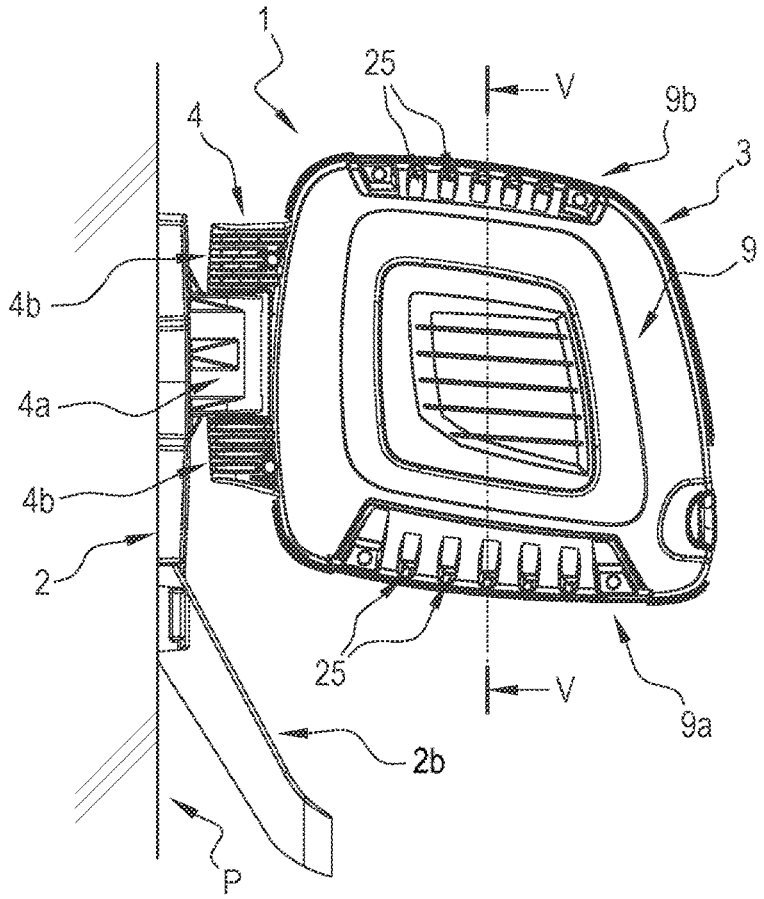
FIG. 4 is a schematic side elevation view of the air compressor according to the invention.

As illustrated in FIGS. 1 and 4, the side guard 9 designed to cover the compression unit 11 has a plurality of slots 25 designed for the circulation of air to and from the compression unit 11.

Advantageously, the above-mentioned slots 25 are made both on a lower portion 9*a* of the guard 9 and on a relative upper portion 9*b*.

As clearly illustrated in FIG. 5, on the shaft 12*a* of the electric motor 12 (not illustrated in the drawings to better display other parts) are keyed two fans 26, 27 respectively lower and upper.

The lower fan 26 is configured to draw cold air coming into the slots 25 made in the lower portion 9*a* of the guard 9.

The upper fan 27 is configured to push hot air coming out from the slots 25 made in the upper portion 9*b* of the guard 9.

In use, the air compressor 1 according to the invention is fixed to the wall P by the above-mentioned and not illustrated screws attached to the plate 2.

In order to use the compressor 1, the user connects a pneumatic tool, not illustrated, at the end 14*a* of the flexible hose 14 emerging from the opening 28 of the supporting and containing body 3.

Once the above-mentioned and not illustrated pneumatic tool is connected to the flexible hose 14, the user, simply by pulling, unwinds from the reel 13 the length of hose 14 required for the purpose of the operations which must be performed.

At this point, by actuating an electric switch 29, advantageously mounted at the front of the supporting and containing body 3, the user actuates the air compression unit 11 which immediately provides compressed air to the pneumatic tool.

If during use the user changes position, the supporting and containment body 3, thanks to the hinge 4 may still oscillate about the axis A1 to facilitate this movement.

At the end of use of the compressed air, in known manner, the user, by means of a simple tug of the flexible hose 14, activates the rewinding by the above-mentioned rewinding means 15.

The air compressor unit 1 according to the invention achieves the preset aims and brings important advantages.

A first advantage connected to the production of an air compressor 1 according to the invention is due to its compact architecture which encloses in one item both the compression unit and the means of winding the hose for distributing the compressed air.

Another advantage linked to the invention is due to the possibility of fastening the above-mentioned assembly to the wall, with the clear result of eliminating any obstruction on the ground of the compartment where the compressor is located.

Further, the presence of a structural central wall 8 makes it possible to have the side guards 9, 10 easily removable for accessing inside the compressor and carrying out any maintenance both on the compression unit and on the winding means.

By adopting the air compressor according to the invention there is further advantage of not generating any obstruction on the ground near the working zone, thereby considerably increasing the safety of users. One need only consider even the simple advantage of not having on the ground the electricity supply cable for the compressor.

What is claimed is:

1. An air compressor which can be fixed to a wall, comprising:

a plate configured to be fixed to a wall, a supporting and containing body hinged on the plate so as to oscillate about a respective predetermined axis of oscillation, an electrically powered air compression unit housed in the supporting and containing body, a winding mechanism including a reel for winding a flexible hose for passage of the compressed air from the air compression unit, the winding mechanism being mounted on the supporting and containing body;

the supporting and containing body comprising a central wall supporting the air compression unit and the winding mechanism, the air compression unit and the winding mechanism being positioned on opposite sides of the central wall;

a rotary distributor element for distribution of the compressed air, configured for transferring to the flexible hose wound around the reel compressed air generated by the air compression unit, the rotary distributor element comprising a hollow cylindrical element attached to the central wall and an external manifold in fluid communication with the cylindrical element and configured to rotate relative to the cylindrical element;

the air compression unit including:

an electric motor with a shaft extending on both a lower side and an upper side of the motor, a lower fan keyed to the shaft on the lower side of the motor and an upper fan keyed to the shaft on the upper side of the motor such that both the lower fan and the upper fan rotate together with the shaft, the lower fan configured to draw air from an exterior of the supporting and containing body into an interior of the supporting and containing body to cool the air compression unit, the upper fan configured to expel the air heated by the air compression unit from the interior of the supporting and containing body to the exterior of the supporting and containing body, the lower fan and the upper fan cooperating to create a flow of the air across the air compression unit.

2. The compressor according to claim 1, wherein the reel is supported rotatably by the central wall to rotate about a respective central axis to determine winding or unwinding of the flexible hose.

3. The compressor according to claim 1, wherein the air compression unit comprises a pumping unit operatively connected to the electric motor, wherein the supporting and containing body comprises a supporting structure, fixed to the central wall and protruding from the central wall, the supporting structure having a first portion configured to rotatably support the shaft of the electric motor, and a second portion for supporting the pumping unit.

4. The compressor according to claim 1, wherein the supporting and containing body comprises two guards located on opposite sides of the central wall and configured to cover, respectively, the air compression unit and the winding mechanism.

5. The compressor according to claim 4, wherein one of the two guards configured to cover the air compression unit includes a plurality of slots configured for air circulation towards and away from the air compression unit.

6. The compressor according to claim 1, wherein the plate comprises at least one housing for pneumatic tools.

7. The compressor according to claim 6, wherein the at least one housing is positioned in a lower portion of the plate, wherein the lower portion is shaped in a cantilever manner, in such a way that the at least one housing is spaced from the wall.

8. The compressor according to claim 1, wherein the plate comprises at least one housing for pneumatic tools.

9. The compressor according to claim 8, wherein the at least one housing is positioned in a lower portion of the plate, wherein the lower portion is shaped in a cantilever manner, in such a way that the at least one housing is spaced from the wall.

10. An air compressor which can be fixed to a wall, comprising:

a plate configured to be fixed to a wall, a supporting and containing body hinged on the plate so as to oscillate about a respective predetermined axis of oscillation, an electrically powered air compression unit housed in the supporting and containing body, a winding mechanism including a reel for winding a flexible hose for passage of the compressed air from the air compression unit, the winding mechanism being mounted on the supporting and containing body;

the supporting and containing body comprising a central wall supporting the air compression unit and the winding mechanism, the air compression unit and the winding mechanism being positioned on opposite sides of the central wall;

the supporting and containing body comprising two guards located on opposite sides of the central wall and configured to cover, respectively, the air compression unit and the winding mechanism;

the air compression unit including:

an electric motor with a shaft extending on both a lower side and an upper side of the motor, a lower fan keyed to the shaft on the lower side of the motor and an upper fan keyed to the shaft on the upper side of the motor such that both the lower fan and the upper fan rotate together with the shaft, the lower fan configured to draw air from an exterior of the supporting and containing body into an interior of the supporting and containing body to cool the air compression unit, the upper fan configured to expel the air heated by the air compression unit from the interior of the supporting and containing body to the exterior of the supporting and containing body, the lower fan and the upper fan cooperating to create a flow of the air across the air compression unit.

11. The compressor according to claim 10, wherein the reel is supported rotatably by the central wall to rotate about a respective central axis to determine winding or unwinding of the flexible hose.

12. The compressor according to claim 10, wherein the air compression unit comprises a pumping unit operatively connected to the electric motor, wherein the supporting and containing body comprises a supporting structure, fixed to the central wall and protruding from the central wall, the supporting structure having a first portion configured to rotatably support the shaft of the electric motor, and a second portion for supporting the pumping unit.

13. The compressor according to claim 10, wherein one of the two guards configured to cover the air compression unit includes a plurality of slots configured for air circulation towards and away from the air compression unit.

14. An air compressor which can be fixed to a wall, comprising:

a plate configured to be fixed to a wall, a supporting and containing body hinged on the plate so as to oscillate about a respective predetermined axis of oscillation, an electrically powered air compression unit housed in the supporting and containing body, a winding mechanism including a reel for winding a flexible hose for passage of the compressed air from the air compression unit, the winding mechanism being mounted on the supporting and containing body;

the supporting and containing body comprising a central wall supporting the air compression unit and the winding mechanism;

a rotary distributor element for distribution of the compressed air, configured for transferring to the flexible hose wound around the reel compressed air generated by the air compression unit, the rotary distributor element comprising a hollow cylindrical element attached to the central wall and an external manifold in fluid communication with the cylindrical element and configured to rotate relative to the cylindrical element;

the air compression unit including:

an electric motor with a shaft extending on both a lower side and an upper side of the motor, a lower fan keyed to the shaft on the lower side of the motor and an upper fan keyed to the shaft on the upper side of the motor such that both the lower fan and the upper fan rotate together with the shaft, the lower fan configured to draw air from an exterior of the supporting and containing body into an interior of the supporting and containing body to cool the air compression unit, the upper fan configured to expel the air heated by the air compression unit from the interior of the supporting and containing body to the exterior of the supporting and containing body, the lower fan and the upper fan cooperating to create a flow of the air across the air compression unit.

15. The compressor according to claim 14, wherein the reel is supported rotatably by the central wall to rotate about a respective central axis to determine winding or unwinding of the flexible hose.

16. The compressor according to claim 14, wherein the air compression unit comprises a pumping unit operatively connected to the electric motor, wherein the supporting and containing body comprises a supporting structure, fixed to the central wall and protruding from the central wall, the supporting structure having a first portion configured to rotatably support the shaft of the electric motor, and a second portion for supporting the pumping unit.

17. The compressor according to claim 14, wherein the supporting and containing body comprises two guards located on opposite sides of the central wall and configured to cover, respectively, the air compression unit and the winding mechanism.

18. The compressor according to claim 17, wherein one of the two guards configured to cover the air compression unit includes a plurality of slots configured for air circulation towards and away from the air compression unit.

19. The compressor according to claim 14, wherein the plate comprises at least one housing for pneumatic tools.

20. The compressor according to claim 19, wherein the at least one housing is positioned in a lower portion of the plate, wherein the lower portion is shaped in a cantilever manner, in such a way that the at least one housing is spaced from the wall.

* * * * *